US007143488B2

(12) United States Patent
McGlothlan

(10) Patent No.: US 7,143,488 B2
(45) Date of Patent: Dec. 5, 2006

(54) DROP EMITTING APPARATUS

(75) Inventor: J. Kirk McGlothlan, Beaverton, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/036,430

(22) Filed: Jan. 13, 2005

(65) Prior Publication Data

US 2005/0122370 A1 Jun. 9, 2005

Related U.S. Application Data

(62) Division of application No. 10/307,682, filed on Dec. 2, 2002, now abandoned.

(51) Int. Cl.
*H04R 17/00* (2006.01)
*B41J 2/15* (2006.01)

(52) U.S. Cl. ..... 29/25.35; 29/890.1; 347/40; 347/20

(58) Field of Classification Search ..... 29/25.35, 29/890.1; 347/48, 68, 70–72, 224, 62, 65, 347/71; 219/121, 121.16, 121.6, 121.65
See application file for complete search history.

(56) References Cited

U.S. PATENT DOCUMENTS 4,680,595 A * 7/1987 Cruz-Uribe et al. ..... 347/40
4,695,854 A * 9/1987 Cruz-Uribe ..... 347/40
4,730,197 A * 3/1988 Raman et al. ..... 347/40

* cited by examiner

*Primary Examiner*—A. Dexter Tugbang
*Assistant Examiner*—Tai Van Nguyen
(74) *Attorney, Agent, or Firm*—Manuel Quiogue; Joseph M. Young

(57) ABSTRACT

A drop emitting device that includes a fluid channel layer, a diaphragm layer having a laser ablated bonding region, and a plurality of electrical components attached to the laser ablated bonding region.

12 Claims, 2 Drawing Sheets

DROP EMITTING APPARATUS

This application is a divisional of prior application Ser. No. 10/307,682, filed Dec. 2, 2002 now abandoned.

BACKGROUND OF THE DISCLOSURE

The subject disclosure is generally directed to drop emitting apparatus, and more particularly to ink jet apparatus.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

A known ink jet drop generator structure employs an electromechanical transducer that is adhesively attached to a metal diaphragm, and it can be difficult to adhesively attach components to a metal surface.

DETAILED DESCRIPTION OF THE DISCLOSURE

Figure 1:
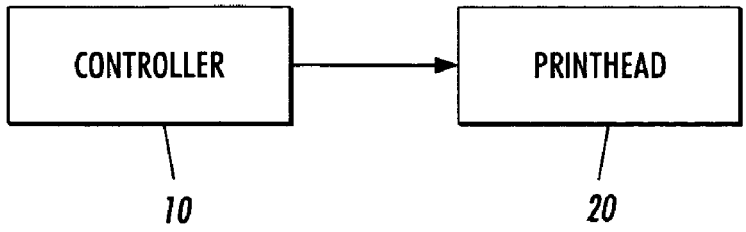
FIG. 1 is a schematic block diagram of an embodiment of a drop-on-demand drop emitting apparatus.

FIG. 1 is a schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer such as a ceramic piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
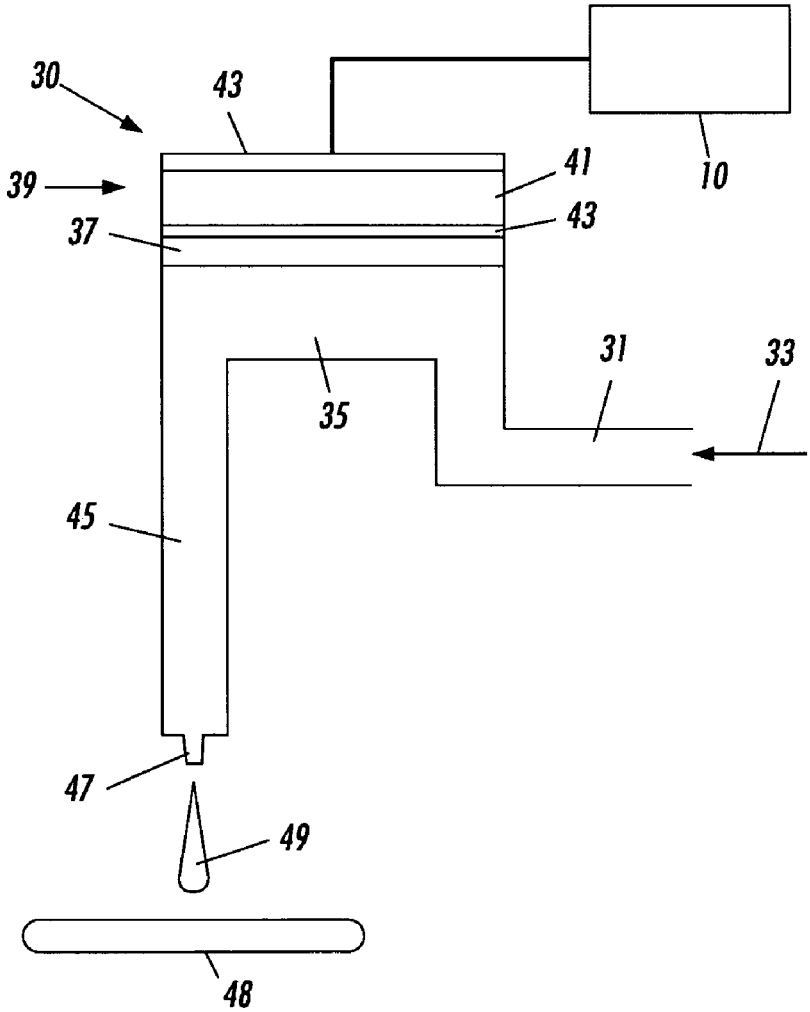
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface, for example. The outlet channel 45 can include a nozzle or orifice 47.

The ink 33 can be melted or phase changed solid ink, and the electromechanical transducer 39 can be a piezoelectric transducer that is operated in a bending mode, for example.

Figure 3:
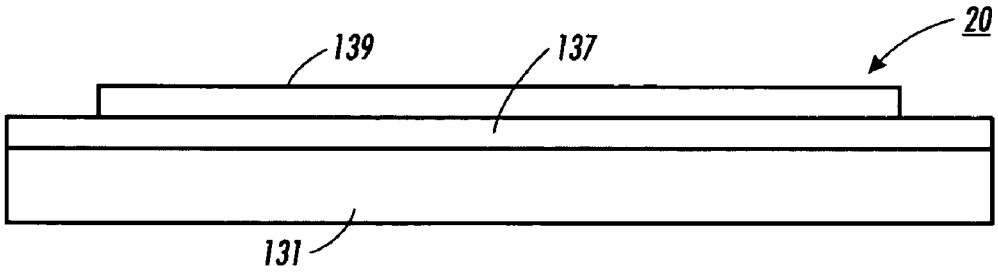
FIG. 3 is a schematic elevational view of an embodiment of an ink jet printhead assembly.

FIG. 3 is a schematic elevational view of an embodiment of an ink jet printhead assembly 20 that can implement a plurality of drop generators 30 (FIG. 2), for example as an array of drop generators. The ink jet printhead assembly includes a fluid channel layer or substructure 131, a diaphragm layer 137 attached to the fluid channel layer 131, and transducer layer 139 attached to the diaphragm layer 137. The fluid channel layer 131 implements the fluid channels and chambers of the drop generators 30, while the diaphragm layer 137 implements the diaphragms 37 of the drop generators. The transducer layer 139 implements the electromechanical transducers 39 of the drop generators 30.

By way of illustrative example, the diaphragm layer 137 comprises a metal plate or sheet such as stainless steel that is attached or bonded to the fluid channel layer 131. Also by way of illustrative example, the fluid channel layer 131 can comprise multiple laminated plates or sheets. The transducer layer 139 can comprise an array of kerfed ceramic transducers that are attached or bonded to the diaphragm layer 137, for example with an epoxy adhesive.

Figure 4:
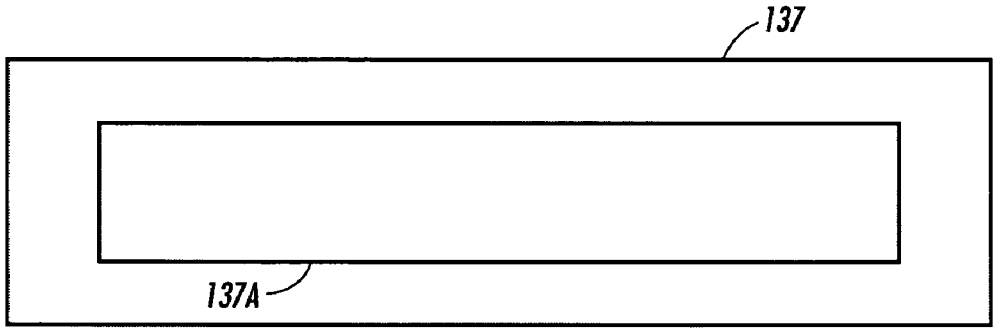
FIG. 4 is a schematic plan view of an embodiment of a metal diaphragm layer of the ink jet printhead assembly of FIG. 3.

FIG. 4 is a schematic plan view of an embodiment of a metal diaphragm layer 137 that includes a rough, non-smooth bonding region 137A formed by laser ablation. The bonding region 137A can comprise a plurality of ablated indentations, pits, spots and/or lines, for example. The transducer layer 139 is bonded to the bonding region 137A which can be formed by stepwise scanning a laser beam across the portion of a metal diaphragm layer that is intended to be the bonding region 137A. The laser beam can be continuous wave (i.e., non-pulsed) or pulsed. An Nd:YAG laser or an Nd:Vanadate laser can be employed, for example at a pulse frequency in a range of 0 KHz to about 150 KHz, wherein 0 KHz refers to continuous wave operation. As another example, the laser can be operated at a pulse frequency in the range of about 6 KHz to about 21 KHz. As yet another example, the laser can be operated at a pulse frequency in the range of about 40 KHz to about 60 KHz. The laser can also be operated at a pulse frequency in the range of about 100 KHz to about 150 KHz. The bonding region 137A can be formed after the metal diaphragm layer is attached to the fluid channel layer 131.

Figure 5:
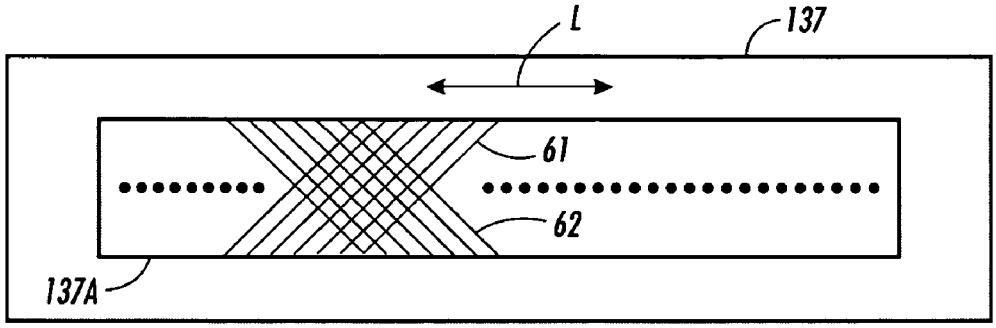
FIG. 5 schematically illustrates examples of scan paths that can be traced by a laser beam in forming a bonding region of the diaphragm layer of FIG. 4.

FIG. 5 schematically illustrates examples of scan paths that can be traced by a laser beam in forming the bonding region of the diaphragm layer. The laser beam would trace a first plurality of substantially parallel paths 61 and a second plurality of substantially parallel paths 62 that are not parallel to the first plurality of scan paths 61. For example the second scan paths 62 can be at about 90 degrees to the first scan paths 62. Also, the first scan paths 61 can be at about 45 degrees to a longitudinal extent L of the bonding region 137A, and the second scan paths 62 can be at about 135 degrees to the longitudinal extent L of the bonding region 137A.

The first substantially parallel scan paths 61 can be overlapping or non-overlapping. Similarly, the second substantially parallel scan paths 62 can be overlapping or non-overlapping.

Figure 6:
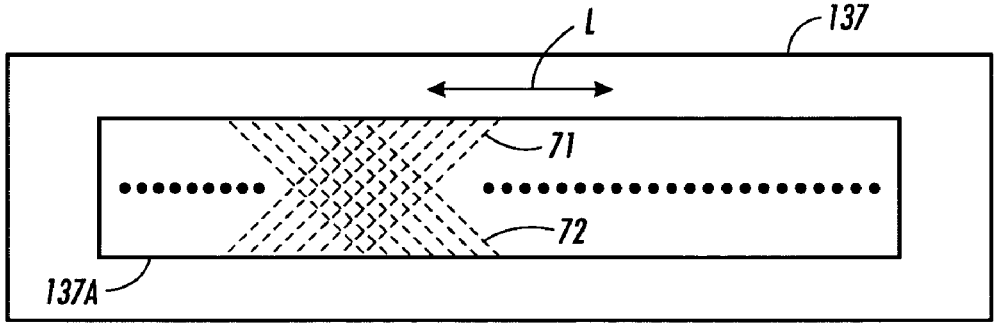
FIG. 6 is a schematic plan view of diaphragm layer that includes a patterned bonding region.

FIG. 6 is a schematic plan view of diaphragm layer that includes a patterned bonding region 137A that can be formed by laser ablation. By way of illustrative example, the bonding region 137A comprises a first plurality of substantially parallel rows 71 of very small laser ablated or re-melted indentations, pits or spots, and a second plurality of substantially parallel rows 72 of very small laser ablated or re-melted indentations, pits or spots. The ablated or re-melted indentations, pits or spots are formed for example by scanning a pulsed laser beam. The first substantially parallel rows 71 are not parallel to the second substantially parallel rows 72.

The first plurality of substantially parallel rows 71 of very small laser ablated pits or spots can be overlapping or non-overlapping. Similarly, the second plurality of substantially parallel rows 72 of very small laser ablated pits or spots can be overlapping or non-overlapping. If overlapping, the ablated pits can have a linear overlap in the range of about 20 percent to about 60 percent, for example. The overlap can be with adjacent ablated pit(s) along a scan line and/or with ablated pit(s) in an adjacent scan line. More generally, the bonding region 137A can include a plurality of overlapping and/or non-overlapping laser ablated indentations, pits or spots.

As another example, the patterned bonding region 137A comprises a first plurality of very small substantially parallel laser ablated or re-melted lines 71, and a second plurality of very small substantially parallel laser ablated or re-melted lines 72. The very small ablated or re-melted lines are formed for example by scanning a continuous wave laser beam. The first substantially parallel rows 71 are not parallel to the second substantially parallel rows 72. The first plurality of very small substantially parallel ablated or re-melted lines 71 can be overlapping or non-overlapping. Similarly, the second plurality of very substantially parallel ablated or re-melted lines 72 can be overlapping or non-overlapping. More generally, the bonding region 137 can include a plurality of laser ablated lines.

It should be appreciated that other electrical components can be attached to the laser ablated bonding region of the metal diaphragm.

The invention has been described with reference to disclosed embodiments, and it will be appreciated that variations and modifications can be affected within the spirit and scope of the invention.

What is claimed is:

1. A drop emitting apparatus comprising:

a fluid channel layer containing fluid channels;

a metal diaphragm plate having a first side and a second side that is opposite the first side;

the first side of the metal diaphragm plate being attached to the fluid channel layer;

a laser ablated bonding region including a plurality if laser ablated lines formed in the second side of the diaphragm plate; and a plurality of electromechanical transducers attached to the laser ablated bonding region.

2. The drop emitting apparatus of claim 1 wherein the plurality of electromechanical transducers comprise piezoelectric transducers.

3. The drop emitting apparatus of claim 1 wherein the plurality of electromechanical transducers comprise ceramic transducers.

4. The drop emitting apparatus of claim 1 wherein the metal diaphragm plate comprises stainless steel.

5. The drop emitting apparatus of claim 1 wherein the laser ablated bonding region including a plurality of laser ablated lines comprises a laser ablated patterned bonding region.

6. The drop emitting apparatus of claim 1 wherein the plurality of laser ablated lines are overlapping.

7. The drop emitting apparatus of claim 1 wherein the laser ablated bonding region is formed by a pulsed laser beam.

8. A drop emitting apparatus comprising:

a fluid channel layer;

a metal diaphragm plate having a first side and a second side that is opposite the first side;

the first side of the metal diaphragm plate being attached to the fluid channel layer;

a laser ablated bonding region including a plurality of laser ablated lines formed in the second side of the diaphragm plate; and a plurality of electrical components attached to the laser ablated bonding region.

9. The drop emitting apparatus of claim 8 wherein the metal diaphragm layer comprises stainless steel.

10. The drop emitting apparatus of claim 8 wherein the laser ablated bonding region including a plurality of laser ablated lines comprises a laser ablated patterned bonding region.

11. The drop emitting apparatus of claim 8 wherein the plurality of laser ablated lines are overlapping.

12. The drop emitting apparatus of claim 8 wherein the laser ablated bonding region is formed by a pulsed laser beam.

* * * * *